United States Patent [19]

Vilines

[11] Patent Number: 5,022,428

[45] Date of Patent: Jun. 11, 1991

[54] ADDITIVE INJECTION SYSTEM

[75] Inventor: Edward J. Vilines, Tulsa, Okla.

[73] Assignee: Aviation Petroleum Inc., Joplin, Mo.

[21] Appl. No.: 548,150

[22] Filed: Jul. 3, 1990

[51] Int. Cl.[5] ..... B67D 5/04

[52] U.S. Cl. ..... 137/209; 137/351

[58] Field of Search ..... 137/209, 351, 267, 205.5, 137/899, 602

[56] References Cited

U.S. PATENT DOCUMENTS

| | | | |
|---|---|---|---|
| 2,163,436 | 6/1939 | Raymond | 137/209 |
| 2,643,616 | 6/1953 | Paxton | 137/209 |
| 3,095,894 | 7/1963 | Jensen | 137/267 |
| 3,109,452 | 11/1963 | Hicks, Jr. | 137/564.5 |
| 3,187,769 | 6/1965 | McDowell et al. | 137/564.5 |
| 3,200,840 | 8/1965 | Watts | 137/564.5 |
| 3,380,462 | 4/1968 | Schieber | 137/209 X |
| 3,776,274 | 12/1973 | Riley | 137/205.5 |
| 3,807,434 | 4/1974 | Rasmussen et al. | 137/205.5 |
| 3,976,087 | 8/1976 | Bolton | 137/351 |
| 4,139,019 | 2/1979 | Bresie | 137/351 |

*Primary Examiner*—Alan Cohan

*Attorney, Agent, or Firm*—Robert E. Massa

[57] ABSTRACT

An apparatus for injecting a chemical additive into a fluid flow stream. In one embodiment, liquid petroleum fuel is being pumped from a storage unit into a tank of a tank truck and a controlled amount of a fuel additive is injected into the flow stream of the petroleum fuel. Preferably, the petroleum fuel is pumped through a line from the storage which is quick-connected to a loading line attached to the tank truck. The chemical additive is pumped from a supply container on the tank truck into the loading line by means of air pressure supplied to the additive container from the tank truck's own air pressure supply system. The fuel additive is pumped at a controllable rate and at a higher pressure than the pressure of the fuel stream.

9 Claims, 3 Drawing Sheets

ADDITIVE INJECTION SYSTEM

FIELD OF THE INVENTION

My invention relates, generally, to chemical injection systems. More particularly, my invention relates to injection systems in which a chemical additive is injected into a flow stream.

Still more particularly, my invention relates to the field of injection system in which an injection fluid is injected as a fluid additive into a major fluid flow stream.

Still more particularly, my invention relates to chemical injection systems in which a chemical fluid additive is injected into a major fluid flow stream of liquid fuel.

BACKGROUND OF THE INVENTION

The science of combining two fluids, or fluid solutions, under controlled conditions includes the art of injecting one fluid, a minor, smaller volume fluid, into a second fluid, a major, or higher volume fluid. The purpose of such a combining of fluids under controlled conditions is usually an attempt to achieve an efficient combining or mixing of components to produce a desired end product.

The chosen controlled conditions under which the combining of fluid components is undertaken will normally depend upon factors which are thought to influence the mixing of the components, such as the manner of mixing, the temperature, the rate of mixing, the amount of heat generated by the mixing, the viscosity and miscibility of the components, and the efficiency of the mixing operation.

The art of injecting a first fluid into a second fluid has been practiced in many ways and for many purposes, as I have had to discover during the development of my own fluid injection system.

In mixing two fluid systems, the accomplishment most sought after is the achievement of an efficient system, a final, thorough mixing of the ingredients in a minimum time with a minimum consumption of energy.

For example, two light molecular weight, non-reacting gaseous components will mix to form a homogeneous product much more readily than will two heavy, viscous liquids.

Within these two extremes, I have been interested in developing a system and equipment for efficiently mixing a minor fluid into a major fluid to prepare a homogeneous mixture.

I have found in the prior art the following U.S. patents for various types of systems for injecting a first fluid into a second fluid:

| | | |
|---|---|---|
| U.S. Pat. No. 3,109,452 | Hicks, Jr. | Nov. 5, 1963 |
| U.S. Pat. No. 3,187,769 | McDowell et al | June 8, 1965 |
| U.S. Pat. No. 3,200,840 | Watts | Aug. 17, 1965 |
| U.S. Pat. No. 3,776,274 | Riley | Dec. 4, 1973 |
| U.S. Pat. No. 3,807,434 | Rasmussen et al | Apr. 30, 1974 |

U.S. Pat. No. 3,109,452 to Hicks, Jr., describes a chemical injector for injecting an emulsion breaker into an oil well fluid. A tank connected to the flow line of the well collects gas from the flow line and is connected to the upper compartment of a piston chamber adjacent the tank, and provides pressure to drive a piston within the chamber downwardly to force emulsion breaker collected below the piston into the flow line and subsequently into the oil and water settling tank with which the flow line is connected.

U.S. Pat. No. 3,187,769 to McDowell et al describes an apparatus connected to a dishwashing machine for controllably injecting a small amount of chemical fluid into the rinse water of a dishwashing machine.

U.S. Pat. No. 3,200,840 to Watts describes a device for injecting a chemical fluid into a feed line from a boiler pump. The device comprises a system of three axially aligned pistons connected between the home water supply and the boiler feed line and is operated by the changes in pressure between the two water supply lines.

U.S. Pat. No. 3,776,274 to Riley describes an apparatus for injecting a chemical fluid into a liquid flowing through a pipe from a container. Tubing connected between the chemical supply container and the flow line provide a pressure differential for withdrawing chemical fluid at adjustable rates from the container and injecting into the flow line.

U.S. Pat. No. 3,807,434 to Rasmassen et al describes an automatic feeder for injecting a fluid containing a chemical additive into a flow stream. The apparatus includes a reservoir for a chemical additive connected between an upstream inlet of the flow stream and a downstream Venturi in the flow stream. The pressure differential in the flow stream developed by the Venturi causes a portion of the flow stream to pass through the reservoir to mix with and move chemical additive from the reservoir into the flow stream. The apparatus is particularly adapted to be connected to a filter system of a swimming pool.

SUMMARY OF THE INVENTION

The primary object of my invention is to provide a system for injecting a first fluid into a second fluid which is efficient and which is easy to operate.

Another object of my invention is to provide an injection system which is easily controllable in operation and which includes a minimum number of components.

Still another object of my invention is to provide a system for injecting a minor fluid into a major fluid efficiently and under easily controllable conditions.

Still another object of my invention is to provide a system for injecting a first fluid into a second in a manner that a homogeneous fluid product may be easily and quickly achieved.

Still another object of my invention is to provide an injection system in which a chemical additive fluid may be easily and controllably injected into a major fluid flow stream.

Still another object of my invention is to provide an injection system which can be portably efficient.

Another object of my invention is to provide a fluid injection system which may be compact, portable, and comprise a few simple components.

I have invented and developed an injection system in which I am able to inject a first fluid into a second fluid. My system is especially convenient to use when the first fluid is considered a chemical additive to be added to the second fluid for some particular and precise purpose, or where the first fluid contains a chemical additive to be added to the second fluid.

I have found that my system is extremely convenient for injecting a minor, or first, fluid stream into a major, or second, fluid stream, particularly when I am relying upon the capability of the minor fluid stream to dispense a chemical additive easily and efficiently into the major fluid stream.

I mixing two fluids, either two gases, two liquids, or a liquid and a gas, to form a homogeneous mixture, with or without reaction of the components, it is most practical to add the minor component to the major component. In this way the mixing can be achieved more effectively than be adding the major component to the minor.

However, the manner of mixing can be accomplished by use of many different devices, as shown by the prior art I have cited, for many different particular purposes.

I have developed my injection system particularly for the purpose of injecting a first, or minor, liquid into a second, or major, liquid, particularly for injecting a minor stream of a liquid petroleum component into a major stream of a petroleum component.

Particularly, with my system I am able to inject efficiently a liquid stream of petroleum additive into a major flow stream of a petroleum product. For example, I have adapted my injection system to the petroleum fuel industry where a minor amount of a fuel additive is to be added to a tank, such as a tank of a tank truck, of petroleum fuel.

In this particular industry, it has been the custom to add the fuel additive after the tank has been filled with the petroleum fuel and rely upon inherent properties of the components and time to effect a mixing of the two liquids. We can readily see that perhaps an efficient mixing might not occur.

I have designed my system so that a small flow stream of the fuel additive, the minor stream, is added to the flow stream of the fuel while the fuel is being loaded into the particular tank for transportation.

In loading a tank truck with a petroleum fuel, the fuel travels through a loading line, under pressure, from a source, or storage means, into the tank with which the loading line is removably attached. Of course, pressure of the flow stream and volume of the fuel are controlled.

I have provided for this particular version of my invention to include a container of chemical additive fluid to be in controllable communication with the fuel loading line through a small line easily removably attachable to the loading line, and with the small additive line under pressure, a higher pressure than that applied to the loading line flow stream. To achieve the higher pressure of the chemical additive line, I attach removably a line from the conventional air pressure supply of the tank truck to an inlet of the container of chemical additive at a most convenient position of the additive container. I also provide in the air pressure line an air pressure regulator valve, an pressure shutoff valve, and an air filter. Both the air pressure line to the chemical additive container and the line connecting the additive container to the loading line of the treated fluid should be connectiable to each component by quick-connect couplers and nipples for ease of, and security of, connection. All lines, an air pressure line to the additive container, an additive line from the container to the treated fluid reservoir, and their respective connections, should be equipped with the proper cutoff valves and check valves, where suitable and necessary.

Thus, as I have generally described my invention in relation to this one particular form of use, the injection of the minor chemical additive flow stream into the major flow stream will be easily accomplished and will permit the two fluids to mix quickly and thoroughly.

The above objects and advantages of my invention will become apparent from my description of the following preferred embodiments of my invention.

DESCRIPTION OF THE PREFERRED EMBODIMENTS

Figure 1:
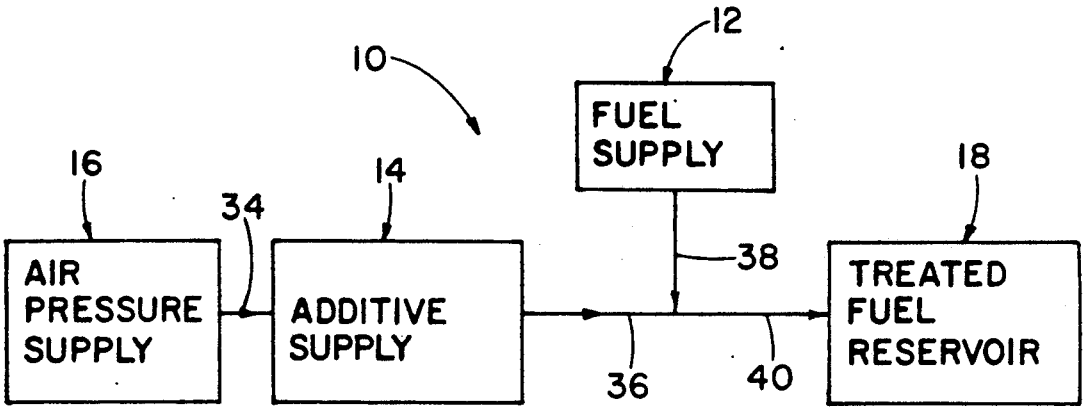
FIG. 1 is a diagrammatic view outlining an injection system according to my invention.

In FIG. 1 I describe an injection system 10, generally, which outlines the basic concept of my invention. To a flow stream of a fuel supply 12, generally, I am forcefully adding a flow stream from an additive supply 14, generally, by means of the force from an air pressure supply 16, generally, in a manner that the pressure given the flow stream of the additive supply 14 is greater than pressure of the flow stream from the fuel supply 12 so that there will be an efficient mixing of the additive flow stream with the flow stream from the fuel supply 12 as the mixture now flows into the treated fuel reservoir 18, generally.

Figure 2:
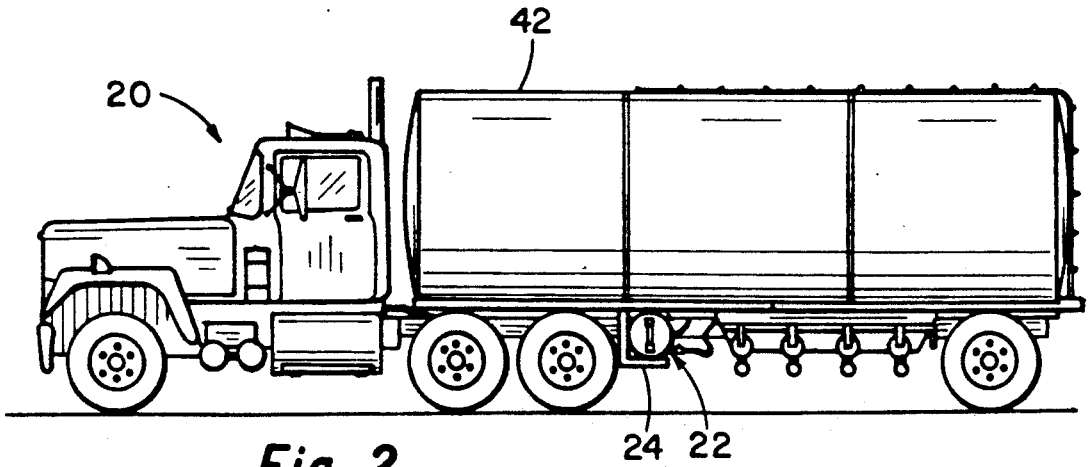
FIG. 2 is a side elevational view of a tank truck showing placement of one embodiment of an injection system according to my invention.

In one particular embodiment of my invention, as I described above, I am able to add a chemical additive to a petroleum fuel as the fuel is being loaded for transport in a tank truck. I exemplify this embodiment of my invention in FIG. 2 in which I show a tank truck 20, generally, upon which I have mounted a portable injection unit 22, generally, according to my invention. I show injection unit 22 more clearly in FIGS. 3 and 6.

Figures 3, 5:
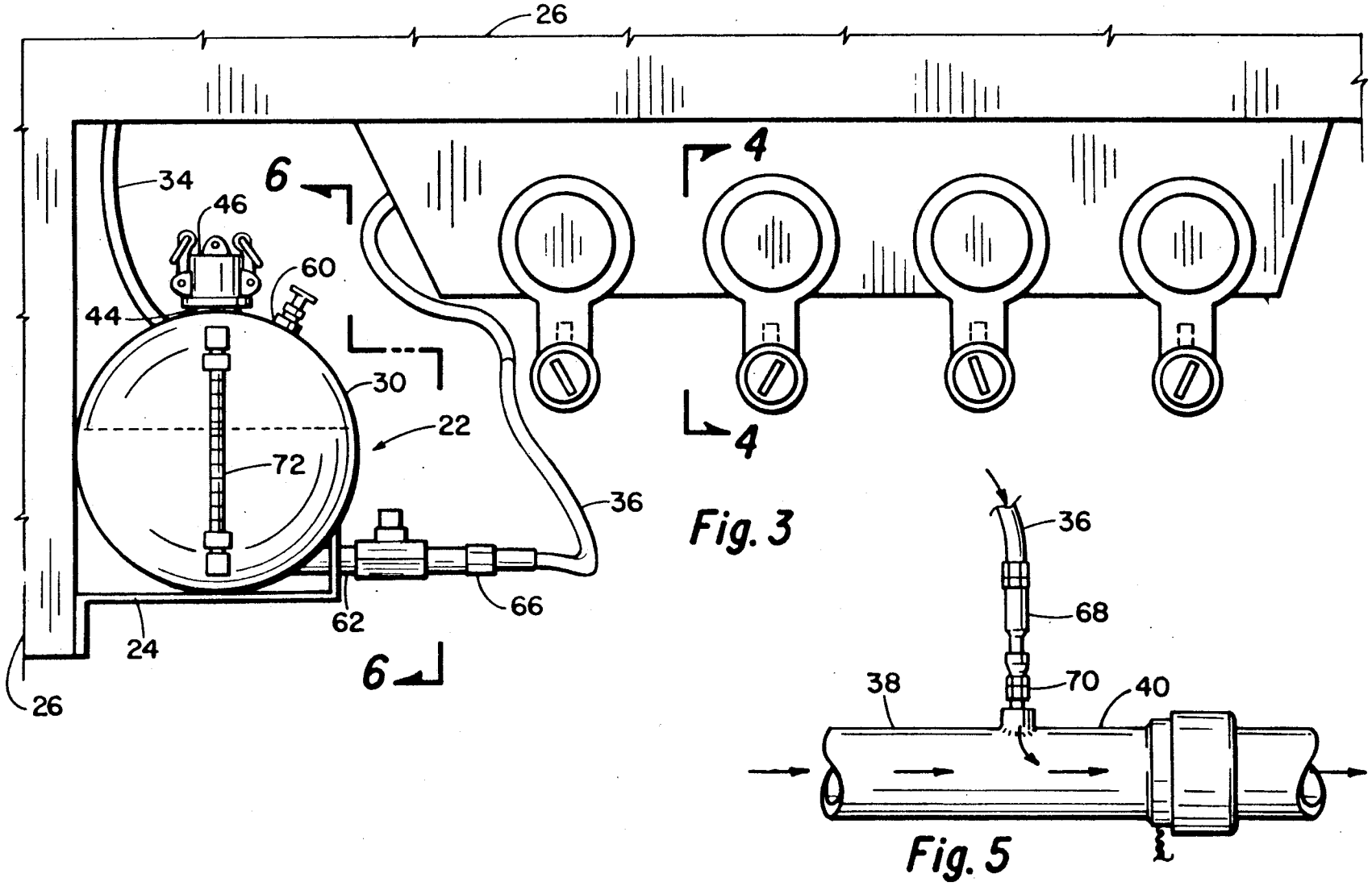
FIG. 3 is a side elevational view of one embodiment of an injection device according to my invention including a partial elevational view of a tank truck, describing one manner of position for my invention.
FIG. 5 is a side elevational view of a portion of a loading line and attachment of a flow line for chemical additive showing the direction of flow of the two liquids.

FIG. 3 is a side elevational view of my portable injection unit 22 mounted upon a bracket 24 which is secured to a lower frame member 26. In this embodiment of my invention, the injection unit 22 is not permanently attached to the lower frame 26, but for the utmost convenience, injection unit 22 rests upon bracket 24 and is held in place by a removable strap 28 arranged to wrap around injection unit 22 and a portion of lower frame 26.

Figure 6:
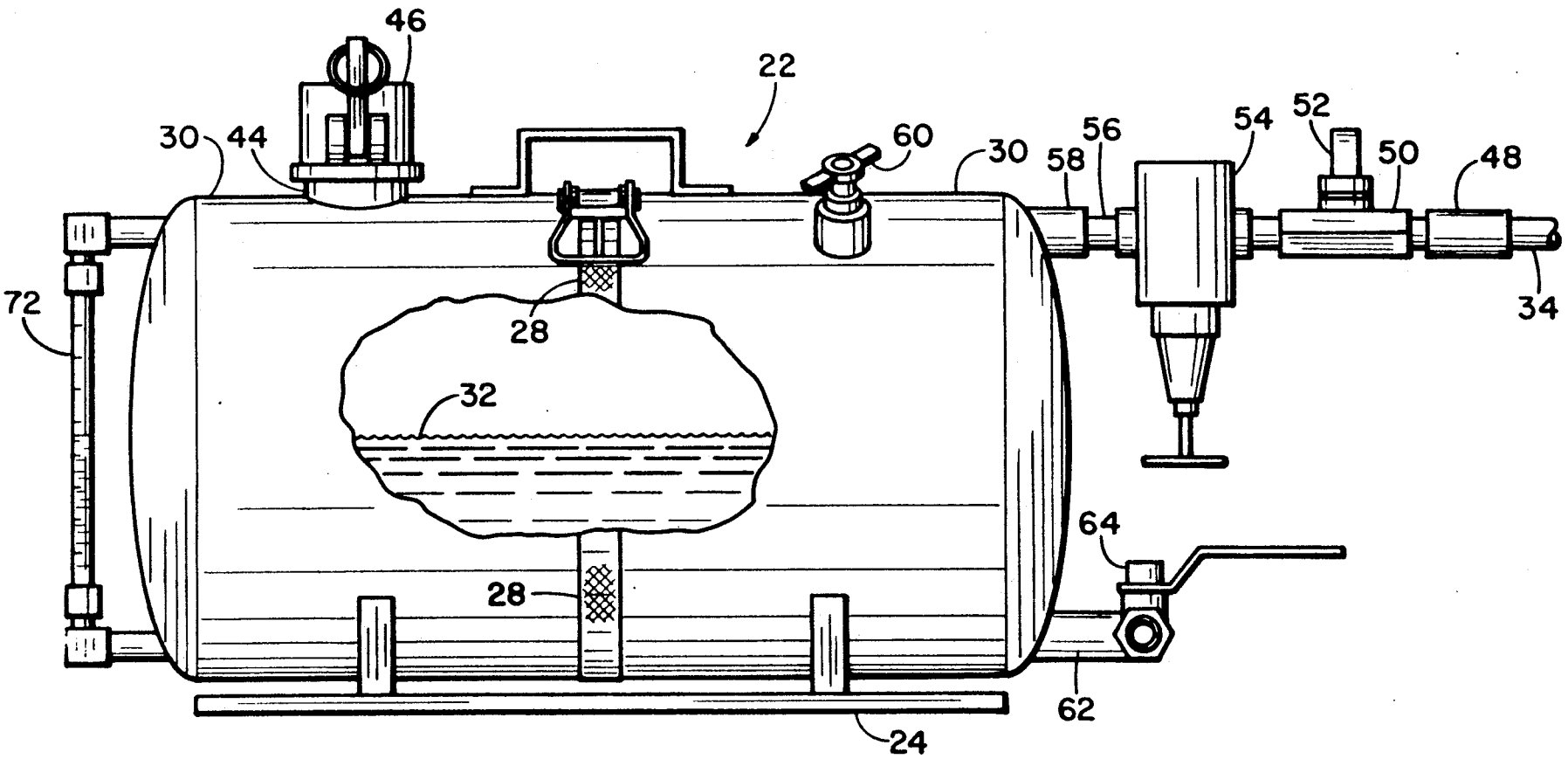
FIG. 6 is a front elevational view of an injection device according to my invention.

Injection unit 22 comprises a tank 30 which is equipped to contain a fuel additive component 32, indicated in FIG. 6 by the cutaway of a portion of the tank 30. Tank 30 is a high pressure tank, capable of withstanding the pressure built up within it by the intrusion of air pressure which is supplied through line 34 shown in FIG. 1, in order to force a flow stream of additive through line 36 from the tank 30 into a flow stream of fuel flowing through line 38 to form a flow stream of treated fuel passing through line 40 into the treated fuel reservoir 18, which, in the use of a tank truck, is shown as tank 42. For my invention I have found it most advantageous to utilize a source of air pressure which is available on the conventional tank truck, which source is shown diagrammatically in FIG. 1, but not shown in the other figures.

FIG. 6 I show an inlet 44 on the tank 30 for loading tank 30 with suitable additive, either as a simple liquid, or as a mixture formed by adding the proper chemical to the liquid. Usually, a fuel additive is added to a petroleum fuel in order to react with and make non-available any water remaining in the fuel. In other industries there might be the need to inject a fluid to which no purposeful chemical has been added, as in the need to add a particular liquid for the purpose of enhancing or reducing flammability or speed of combustion.

Inlet 44 is covered by a conventional removable cap 46.

In communication with air line 34 and tank 30, I have provided an air filter 48 attached by a quick-connect coupler 50 upon which I have secured a hand valve 52 for easily opening and closing the air line 34. Then, at the other end of quick-connect coupler 50, I have attached an air pressure regulator 54, which, in most uses, should be capable of regulating the air pressure entering the tank over a range of from 10 to 120 psi, as needed. Air pressure regulator 54 communicates through a short length of tubing 56 to air inlet 58 of the tank 30.

I have also provided a bleeder valve 60 in communication with tank 30 which will permit easy and convenient release or air pressure from the tank 30 as required.

To an outlet 62 on the tank 30 I have attached a hand valve 64 which I have connected to the additive line 36 by means of a quick-connect coupler 66 (shown in FIG. 6). Additive line 36 is connected to the fuel loading line 38 by means of a quick-connect coupler 68 which is easily connectible to a tubing connection 70 welded into fuel line 38. Then, as I show by the flow diagram of FIG. 5, as the fuel additive flows into the fuel line 38, the mixture of additive, at the higher pressure than the fuel flow stream, I describe the line containing the flow stream of the mixture as treated fuel line 40.

On tank 30 I have provided a typical liquid level graduate, which is one form of device for measuring the amount of liquid present in the tank 30.

Figure 4:
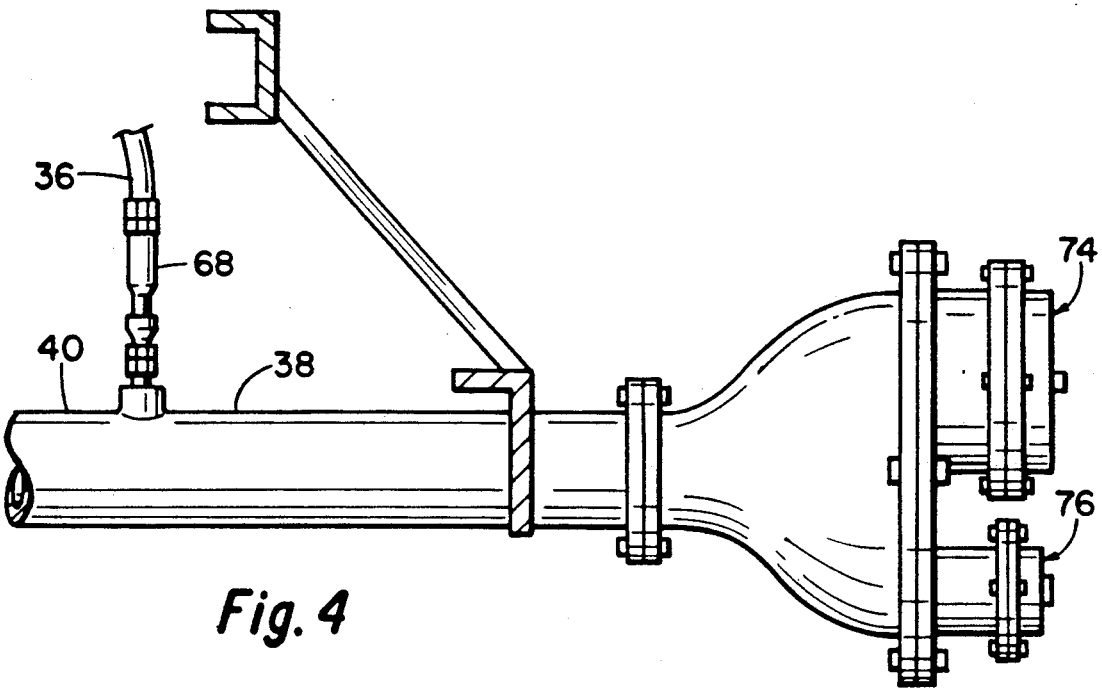
FIG. 4 is a partial view along the lines 4—4 of FIG. 3 showing a typical loading line with which an embodiment of my invention cooperates.

In FIG. 4 I show a typical connection for a tank truck. An upper connection 74, generally, is a loading connection for connection to a source of fuel when the tank truck is being loaded, and a lower connection 76, generally, is used when the tank truck is delivering fuel to a customer.

Since many different embodiments of my invention may be made without departing from the spirit and scope thereof, it is to be understood that the specific embodiments described in detail herein are not to be taken in a limiting sense, since the scope of the invention is best defined by the appended claims.

I claim:

1. An apparatus for injecting a chemical additive fluid into a major fluid flow stream flowing through a loading line, comprising:

a source of the major fluid flowing through the loading line in communication with the loading line, the major fluid comprising fuel fluid, a reservoir for treated fluid comprising a fuel tank mounted on a transport component, the treated fluid comprising a portion of the major fluid with a portion of chemical additive fluid added thereto, the loading line attached to the reservoir for treated fluid for providing means for transferring fluid from the source of the major fluid to the reservoir for treated fluid, a high pressure container for the chemical additive fluid, the container having an inlet for loading chemical additive fluid, an outlet providing means for communication of the container with the loading line, and an air inlet providing means for communication of the container with an air pressure supply to provide pressurization of the container for driving chemical additive fluid into the loading line at a higher pressure than the pressure of the major fluid flow stream, the air inlet including an air pressure regulator, an air pressure shutoff valve, and the air pressure supply includes an air supply line in communication with the air inlet of the container, and the air supply line includes an air filter.

2. An apparatus for injecting a chemical additive fluid into a major fluid flow stream flowing through a loading line as described in claim 1, wherein the fuel fluid comprises liquid fuel.

3. An apparatus for injecting a chemical additive fluid into a major fluid flow stream flowing through a loading line as described in claim 2, wherein the high pressure container for the chemical additive fluid includes a gauge mounted on the container to indicate the amount of chemical additive present in the container, and a bleeder 4 valve mounted on the container for release of air pressure.

4. An apparatus for injecting a chemical additive fluid into a major fluid flow stream flowing through a loading line as described in claim 3, which includes a bracket supporting the high pressure container in place on the transport component.

5. An apparatus for injecting a chemical additive fluid into a major fluid flow stream flowing through a loading line as described in claim 4, wherein the bracket is secured to the transport component.

6. An apparatus for injecting a chemical additive fluid into a major fluid flow stream flowing through a loading line as described in claim 5, which includes a strap securing the contain removably in place on the bracket.

7. An apparatus for injecting a chemical additive fluid into a major fluid flow stream flowing through a loading line, comprising:

a source of the major fluid flowing through the loading line in communication with the loading line, the major fluid comprising liquid fuel, a reservoir for treated fluid comprising a fuel tank mounted on a transport component, the treated fluid comprising a portion of the major fluid with a portion of chemical additive fluid added thereto, the loading line attached to the reservoir for treated fluid for providing means for transferring fluid from the source of the major fluid to the reservoir for treated fluid, a high pressure container for the chemical additive fluid mounted on the transport component, the high pressure container having an inlet for loading chemical additive fluid, an outlet providing means for communication of the high pressure with the loading line, and an air inlet providing means for communication of the container with an air pressure supply to provide pressurization of the container for driving chemical additive fluid into the loading line at a higher pressure than the pressure of the major fluid flow stream.

8. An apparatus for injecting a chemical additive fluid into a major fluid flow stream flowing through a loading line as described in claim 7, wherein the air pressure supply includes an air suppply line in communication with the air inlet of the high pressure container, and the air supply line includes an air filter.

9. An apparatus for injecting a chemical additive fluid into a major fluid flow stream flowing through a loading line as described in claim 8, wherein the high pressure container for the chemical additive fluid includes a gauge mounted on the container to indicate the amount of chemical additive present in the container, and a bleeder valve mounted on the container for release of air pressure.

* * * * *